US006424302B1

(12) United States Patent
Wu

(10) Patent No.: US 6,424,302 B1
(45) Date of Patent: Jul. 23, 2002

(54) SIMPLIFIED DUAL-FREQUENCY ANTENNA FOR MOBILE PHONE

(75) Inventor: Mao-Sung Wu, Taoyuan (TW)

(73) Assignee: Senton Enterprise Co., Ltd., Taoyuan (TW)

( * ) Notice: Subject to any disclaimer, the term of this patent is extended or adjusted under 35 U.S.C. 154(b) by 4 days.

(21) Appl. No.: 09/739,806

(22) Filed: Dec. 20, 2000

(51) Int. Cl.[7] ..... H01Q 1/24; H01Q 1/36
(52) U.S. Cl. ..... 343/702; 343/895
(58) Field of Search ..... 343/895, 702, 343/872; 455/90

(56) References Cited

U.S. PATENT DOCUMENTS 5,539,417 A * 7/1996 Terry et al. ..... 343/702
5,977,931 A * 11/1999 Openlander ..... 343/895
6,069,592 A * 5/2000 Wass ..... 343/895

* cited by examiner

*Primary Examiner*—Don Wong
*Assistant Examiner*—James Clinger
(74) *Attorney, Agent, or Firm*—Birch, Stewart, Kolach & Birch, LLP

(57) ABSTRACT

A simplified dual-frequency antenna for mobile phone includes an integrally stamped thin metal conductor to function as a frequency-control structure of the antenna. An upper end of the stamped thin metal conductor is a curved wave coil and a lower end thereof is an elongated contact head. The curved wave coil includes horizontal and vertical wave segments adapted to two different frequencies of 900 MHz and 1800 MHz, respectively. A cover encloses the curved wave coil to protect the coil against impact and deformation. The contact head has a stop ring mounted around a lower portion thereof and adapted to tightly fit in a lower opening of the cover. The stop ring is integrally provided at a predetermined distance below it with a bolt. By screwing the bolt into an antenna jack on a mobile phone, the antenna is removably connected to the mobile phone with a lower end of the contact head contacting with a conductive leaf spring in the mobile phone, enabling the mobile phone to receive signals.

5 Claims, 4 Drawing Sheets

SIMPLIFIED DUAL-FREQUENCY ANTENNA FOR MOBILE PHONE

BACKGROUND OF THE INVENTION

1. Field of the Invention

The present invention relates to a simplified dual-frequency antenna for mobile phone, and more particularly to a simplified dual-frequency antenna that has a stop ring with a lower bolt provided at a lower end thereof to enable quick and removable connection of the antenna to a mobile phone by screwing the lower bolt into an antenna jack on the mobile phone.

2. Description of the Related Art

FIGS. 1 and 2 are exploded and assembled perspective views, respectively, of a conventional antenna for mobile phone. The conventional antenna for mobile phone mainly includes two spring coils 10, 20 having large and small coil sizes, respectively, for putting around outer and inner wall surfaces, respectively, of a hollow insulting sleeve 30, and a link 40 connected to a bottom of the sleeve 30. The sleeve 30 is then covered with a protective casing (not shown). Through frequency matching and selection for the two spring coils 10, 20 at outer and inner sides of the insulating sleeve 30, the antenna is adapted to use with a dual-frequency mobile phone.

The spring coils 10, 20 are usually ready-made products. They are manufactured by winding wires around dies and manually adjusting the dies from time to time for the resultant spring coils 10, 20 to meet required specifications, including wire gauge for forming the spring coil, the coil size, the coil spacing, and the length of the coil. It is possible to effectively control such specifications when there is only a small quantity of spring coils to be produced through a die. However, when a large quantity of spring coils 10, 20 are produced, there would be difference in the specifications of the spring coils 10, 20 produced in different batches due to offset or deformation of dies having been used for a long time and some factors that could not be fully overcome in the manufacturing process. Spring coils 10, 20 that do not uniformly meet all the required specifications would inevitably adversely affect the accuracy of the antenna frequency. Moreover, the spring coils 10, 20 tend to compress and tangle with one another and become deformed during packing and transportation. The spring coils are subject to deformed coil spacing when an operator careless pulls the spring coils, making the antenna using these deformed coil springs failed to match the selected frequencies and resulted in poor signal receiving.

The conventional antenna for mobile phone also includes complicate components and requires multiple steps to assemble the antenna and therefore need higher manufacturing costs.

SUMMARY OF THE INVENTION

It is therefore a primary object of the present invention to provide a simplified dual-frequency antenna that could be easily protected with a cover and quickly and removably connected to a mobile phone.

To achieve the above and other objects, the simplified dual-frequency antenna for mobile phone of the present invention includes an integrally stamped thin metal conductor to function as a frequency-control structure of the antenna. An upper end of the stamped thin metal conductor is a curved wave coil and a lower end thereof is an elongated contact head. The curved wave coil includes horizontal and vertical wave segments adapted to two different frequencies of 900 MHz and 1800 MHz, respectively. A cover encloses the curved wave coil to protect the coil against impact and deformation. A stop ring with a lower bolt is mounted around a lower portion of the elongated contact head, such that the stop ring is tightly fitted in the cover with the lower bolt exposed from a lower opening of the cover. The lower bolt is adapted to screw into an antenna jack on a mobile phone for a lower end of the elongated contact head to contact with a conductive leaf spring in the mobile phone and for the whole dual-frequency antenna to quickly and removably connect to the mobile phone.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein The structure and the technical means adopted by the present invention to achieve the above and other objects can be best understood by referring to the following detailed description of the preferred embodiments and the accompanying drawings which are given by way of illustrating only, and thus are not limitative of the present invention, wherein.

DETAILED DESCRIPTION OF THE PREFERRED EMBODIMENTS

Figure 1:
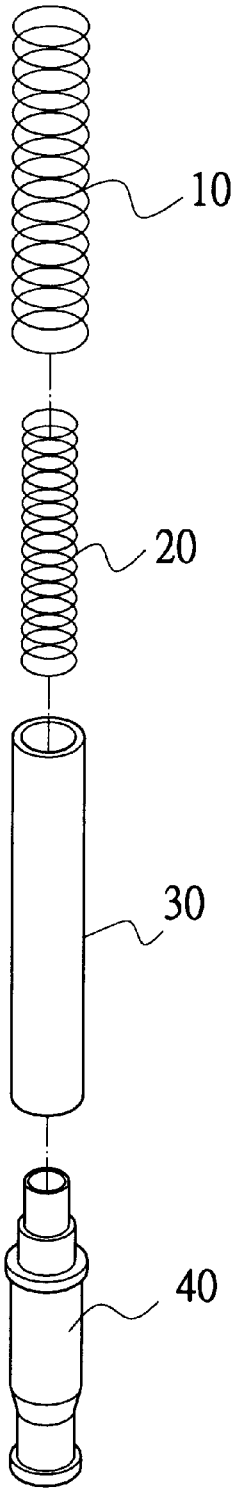
(PRIOR ART) Fig.1
FIG. 1 is an exploded perspective of a conventional dual-frequency antenna for mobile phone.
Figure 2:
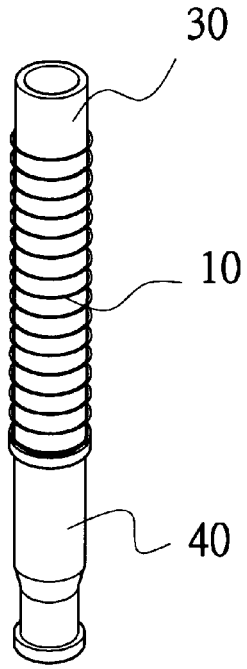
(PRIOR ART) Fig.2
FIG. 2 is an assembled perspective of the conventional dual-frequency antenna of FIG. 1.
Figure 3:
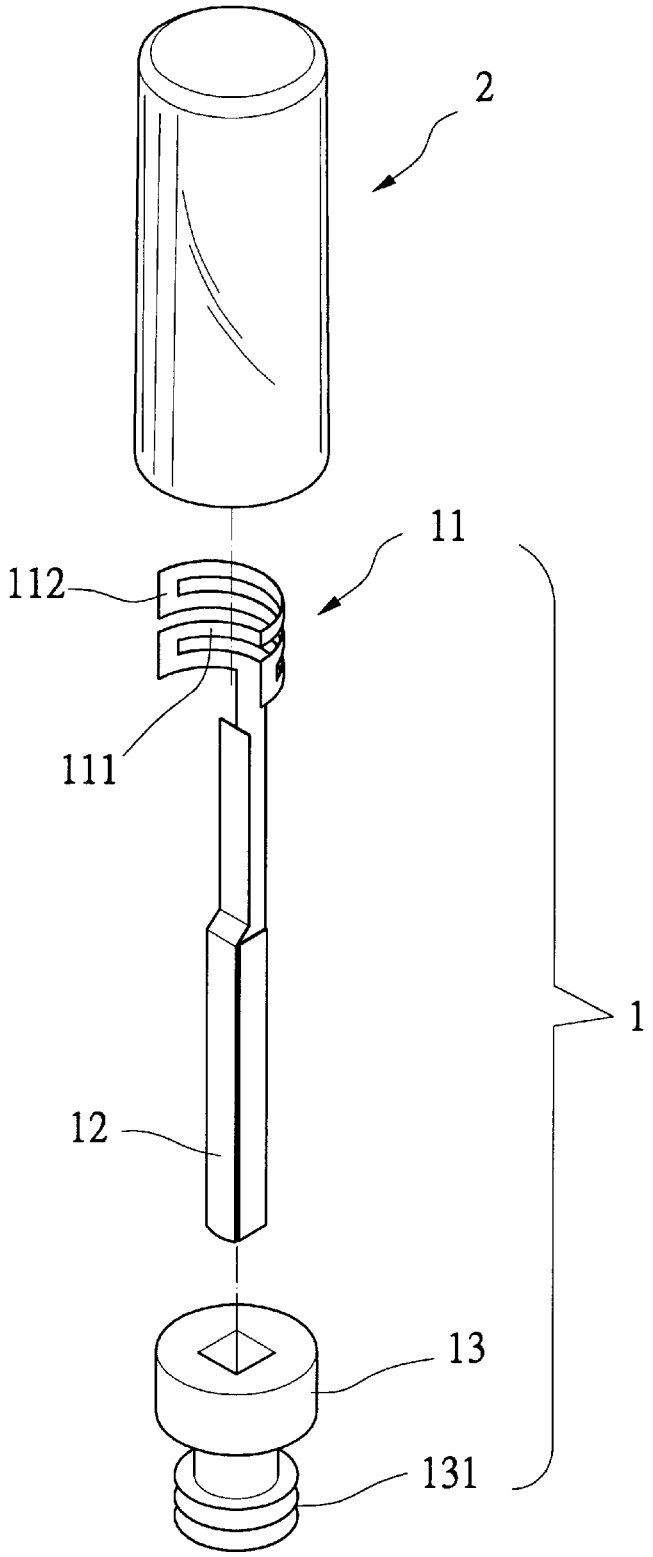
FIG. 3 is an exploded perspective of a simplified dual-frequency antenna for mobile phone according to the present invention.

Please refer to FIG. 3 that is an exploded perspective of a simplified dual-frequency antenna for mobile phone according to the present invention. As shown, the antenna mainly includes a main body 1 and a cover 2.

The main body 1 is made of a thin metal conductor that is integrally stamped into a desired shape to include a curved wave coil 11 at an upper end thereof and an elongated contact head 12 at a lower end thereof. The curved wave coil 11 includes horizontal wave segments 111 and vertical wave segments 112 adapted to two different frequencies of 900 MHz and 1800 MHz, respectively. A stop ring 13 is mounted around a lower portion of the elongated contact head 12 and has a bolt 131 integrally provided at a predetermined distance below it.

The cover 2 is made of an insulating plastic material. A curvature of an inner wall of the cover 2 matches with that of the curved wave coil 11.

The stop ring 13 is made of a material the same as that for making the cover 2 and has an external diameter equal to an inner diameter of the cover 2.

Figure 4:
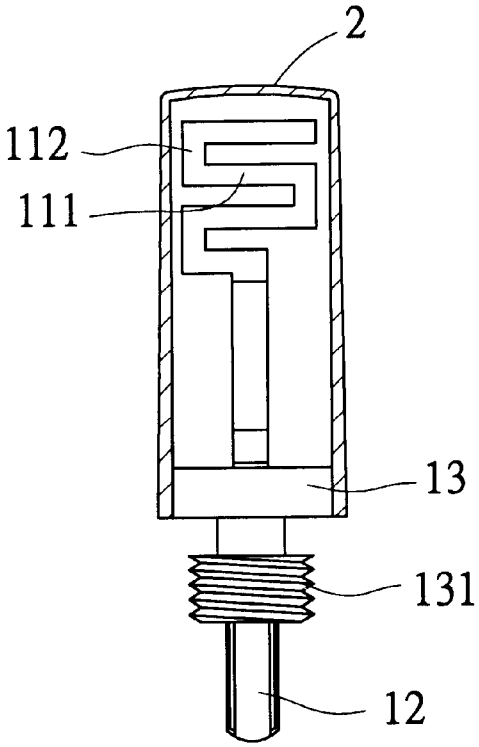
FIG. 4 is an assembled sectional view of the simplified dual-frequency antenna of FIG. 3 before connecting to a mobile phone.
Figure 5:
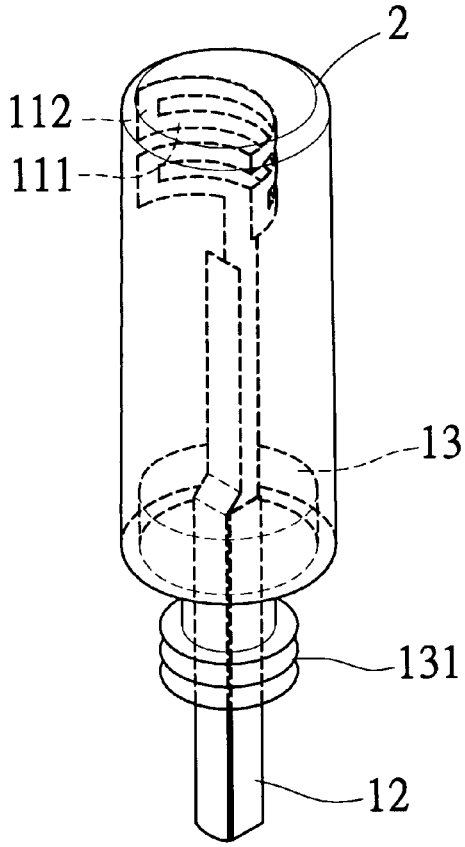
FIG. 5 is an assembled perspective of the simplified dual-frequency antenna of FIG. 3 before connecting to a mobile phone.
Figure 6:
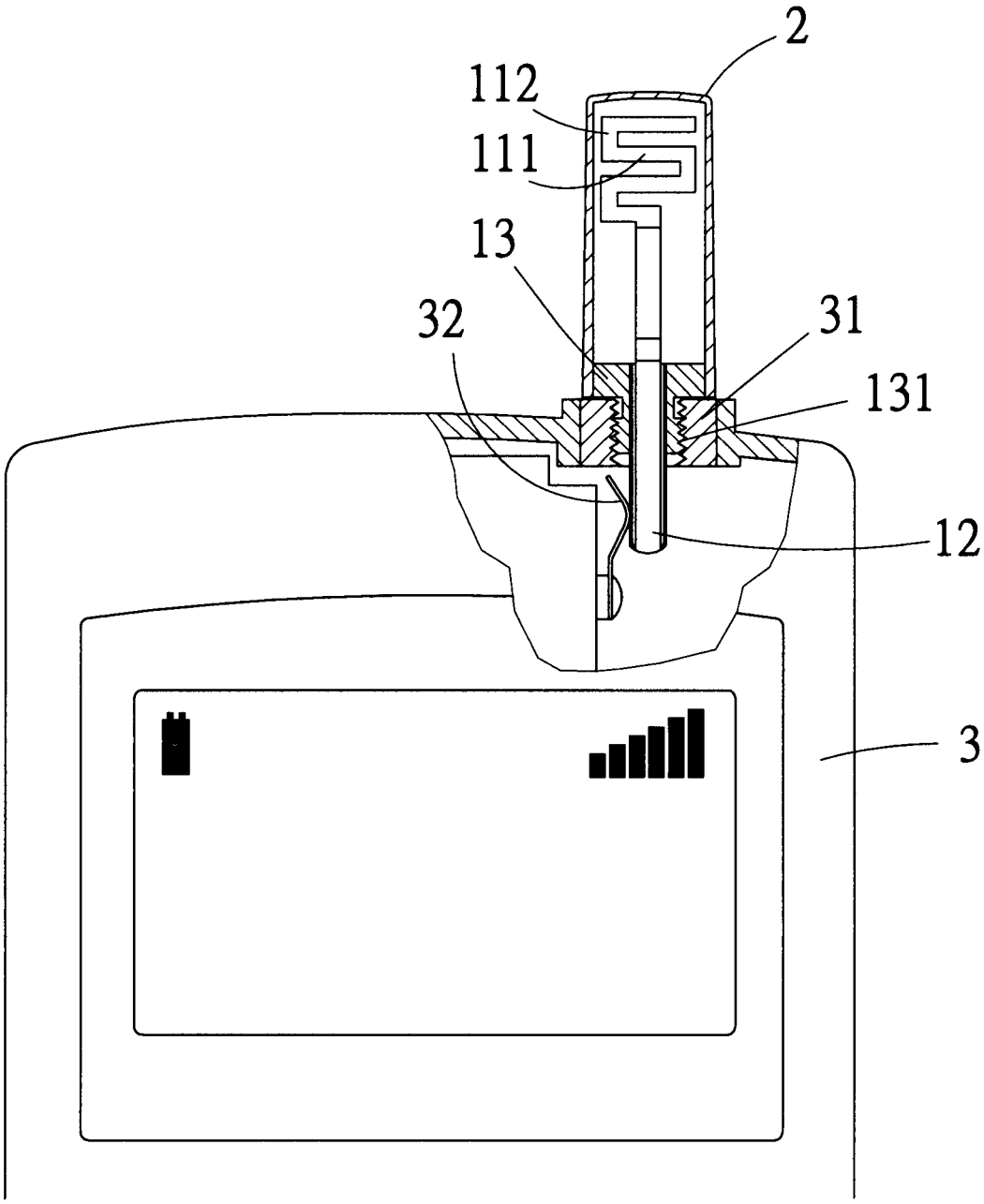
FIG. 6 is an assembled sectional view of the simplified dual-frequency antenna of FIG. 3 having been connected to a mobile phone.

Please refer to FIGS. 4, 5 and 6. In assembling the antenna of the present invention to a mobile phone 3, the main body 1 is forward extended into the cover 2 from a bottom opening of the cover 2, so that the curved wave coil 11 at the upper end of the main body 1 is completely located in the cover 2 and the stop ring 13 is tightly fitted in the cover 2 with a lower surface of the stop ring 13 flushing with the bottom opening of the cover 2, enabling the main body 1 to firmly associate with the cover 2. The cover 2 protects the curved wave coil 11 therein against impact and deformation. Thereafter, the associated main body 1 and cover 2 is connected to the mobile phone 3 by fully screwing the bolt 131 into an antenna jack 31 provided on the mobile phone 3. At this point, the contact head 12 extends into the antenna jack 31 and contacts with a conductive leaf spring 32 provided in the mobile phone 3, enabling the mobile phone 3 to accurately receive signals of any one of two different frequencies of 900 MHz and 1800 MHz.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A simplified dual-frequency antenna for a mobile phone, comprising a main body and a cover;

said main body being made of a thin metal conductor that is integrally stamped into a desired shape to include a curved wave coil at an upper end and an elongated contact head at the lower end of said main body; said curved wave coil including horizontal wave segments and vertical wave segments adapted to two different frequencies of 900 MHz and 1800 MHz, respectively; and said elongated contact head at the lower end of said main body having a stop ring mounted around a lower portion thereof, said stop ring being integrally provided at a predetermined distance below it with a bolt adapted to screw into an antenna jack provided on a mobile phone; and said cover being made of an insulating plastic material and having a shape suitable for protectively enclosing said curved wave coil of said main body therein with said stop ring tightly fitted in a lower opening of said cover;

whereby when said elongated contact head is inserted into said antenna jack on said mobile phone and said bolt is fully screwed into said antenna jack, said main body protectively enclosed by said cover is quickly and removably connected to said mobile phone with a lower end of said contact head contacting with a conductive leaf spring provided in said mobile phone, enabling said mobile phone to accurately receive signals.

2. The dual-frequency antenna as recited in claim 1, further comprising open spaces provided between at least some of the horizontal wave segments of the curved wave coil, such that the main body is open between the at least some horizontal wave segments.

3. The dual-frequency antenna as recited in claim 1, further comprising open spaces provided adjacent the vertical wave segments of the curved wave coil, such that the main body is open at side portions opposed to the vertical wave segments.

4. The dual-frequency antenna as recited in claim 1, wherein the horizontal wave segments and the vertical wave segments are formed when the main body is stamped and wherein the main body in the region of the wave segments is curved about an axis and wherein the curved portion of the main body fails to extend completely around the axis such the one side of the main body is out of contact with another side of the main body.

5. The dual-frequency antenna as recited in claim 1, wherein the upper end of the main body at the curved wave coil partially surrounds an open space.

* * * * *